United States Patent [19]

Frank

[11] Patent Number: 4,475,364

[45] Date of Patent: Oct. 9, 1984

[54] DOOR-BARRING LOCK APPARATUS

[75] Inventor: Carl A. Frank, River Vale, N.J.

[73] Assignees: Claire D. Frank; Gerald A. Frank; Anne Spisak; John J. Palermo; G. Kendall Parmelee; Susan L. Burns

[21] Appl. No.: 293,167

[22] Filed: Aug. 17, 1981

[51] Int. Cl.[3] ..... E05B 9/08; E05B 65/06; E05C 3/04; E05C 3/10

[52] U.S. Cl. ..... 70/139; 70/451; 292/207; 292/336.3; 292/336.5; 292/358

[58] Field of Search ..... 70/135, 136, 137, 139, 70/379 R, 92, 451, 449, 416–418, 465; 192/67 P, 67 R; 292/92, 202, 204, 207, 195, 214, 218, 336.3, 336.5, 352, 358, DIG. 27, DIG. 55, DIG. 65

[56] References Cited

U.S. PATENT DOCUMENTS

| | | | |
|---|---|---|---|
| 401,003 | 4/1889 | Burns | 292/DIG. 27 |
| 1,407,115 | 2/1922 | Bailey | 192/67 P |
| 1,438,164 | 12/1922 | Andrew | 70/135 |
| 2,469,601 | 5/1949 | Lee | 292/DIG. 27 |
| 2,677,967 | 5/1954 | Galbraith | 192/67 P |
| 4,037,488 | 7/1977 | Laney | 192/67 P |

FOREIGN PATENT DOCUMENTS

| | | | |
|---|---|---|---|
| 285850 | 4/1915 | Fed. Rep. of Germany | 70/379 R |
| 2627029 | 12/1977 | Fed. Rep. of Germany | 292/358 |

*Primary Examiner*—Robert L. Wolfe
*Attorney, Agent, or Firm*—Parmelee, Bollinger & Bramblett

[57] ABSTRACT

Door-barring lock apparatus has a bar member rotatably mounted to the wall near the doorway. When in a transverse or generally horizontal position, this bar member projects into the doorway for engaging the inside of the door near the opposite margin from the hinges for advantageously, positively barring the door against opening inwardly. By manipulation of a handle located inside of the building near the bar member, a person inside of the building can de-couple the bar from a locking rod extending through the wall to the outside of the building. Such de-coupling enables the person inside of the building to rotate the bar into an upright position for freeing the door to allow the door to be opened, regardless of whether this rod is locked against rotation. A lock assembly accessible from the outside of the building normally serves to lock the rod against rotation for normally locking the bar member in its transverse door-barring position. By unlocking this lock assembly and turning the lock, the rod becomes rotated for rotating the bar member from its transverse to its upright position for allowing a person outside of the building to open the door, or conversely to rotate the bar member from its upright to its transverse position for barring the door from the outside.

16 Claims, 6 Drawing Figures

DOOR-BARRING LOCK APPARATUS

FIELD OF THE INVENTION

This invention is in the field of door locks and more particularly relates to door-barring lock apparatus in which a bar member rotatably mounted to the wall near the doorway in its locked position projects into the doorway for engaging the inside of the door near the opposite margin from the hinges for advantageously, positively barring the door and in its upright position frees the door for opening.

BACKGROUND OF THE INVENTION

In the customary installation an entrance door is hinged in a doorway and swings inwardly when the door is unlocked. The doorway is defined by a frame mounted in the wall of the building. The vertical portion of the frame near the edge of the door is known as the jamb. The locking mechanism for the door is usually mounted on the door and includes a bolt which engages in a socket in the jamb for locking the door.

A burglar intent upon breaking and entering the building can often forcefully kick against the door near the lock. The result of such a powerful inward thrust against the margin of the door is often to tear the lock mechanism away from its mounting on the door or to tear the bolt through the socket in the jamb or partially to tear both lock mounting and bolt socket sufficiently that the entrance door is allowed to swing inwardly to admit the burglar.

If the burglar is concerned about detection resulting from the crashing, bursting sound resulting from the first approach, a second approach is to pry the margin of the door and the jamb away from each other sufficiently far that the end of the bolt barely clears the socket in the jamb for allowing the door to swing inwardly. There are portable, battery-operated electric drills which are relatively quiet in operation. The burglar drills a hole through the doorstop at the very edge of the door immediately adjacent to the jamb on the opposite side from the hinges. The end of a prying tool is inserted into this hole between the jamb and the edge of the door. The prying tool provides a tremendous mechanical advantage through which the burglar can force the edge of the door and the jamb sufficiently far apart that the bolt no longer reaches into the socket. The door can now be swung open almost noiselessly.

SUMMARY OF THE INVENTION

The present invention overcomes these problems with conventional door locks by advantageously, positively barring the door for preventing the door from opening even if an attempt is made to force entry by prying the jamb and door away from each other.

In accordance with the presently preferred embodiments of this invention, the door-barring lock apparatus includes an elongated rotatable rod extending through the wall of the building near the doorway on the opposite side of the doorway from the location of the hinges for the door. This rod extends through the wall from the inside to the outside of the building, and anchor means associated with this rod are secured to the wall. This rod is rotatable about its own axis relative to said anchor means. There is a lock available from the outside of the building near the doorway having a rotatable lock plug which can be in a locked condition and in an unlocked condition. When this lock plug is in its locked condition, it prevents the rod from rotating relative to the anchor means. This lock plug in its unlocked condition enables the rod to be rotated by said lock plug. There is a rotatable door bar member mounted on the inside of the wall near the doorway which in its transverse position engages the inside of the door on the opposite side from the hinges for barring the door against opening inwardly, and which in its upright position is located away from the door for unbarring the door for allowing the door to be opened. Coupling means normally couples this bar member to the inner end of the rod for enabling the door to be barred or unbarred from the outside by use of the lock. A handle is associated with the coupling means for de-coupling the bar member from the rod for permitting the bar member to be turned between its transverse and upright positions by a person inside of the building, regardless of the fact that the lock plug is in its locked condition, for enabling the door to be barred or unbarred from the inside of the building by manipulation of the handle.

BRIEF DESCRIPTION

The various aspects, objects, features and advantages of the door-barring lock apparatus of the present invention will become more fully understood from a consideration of the accompanying drawings in conjunction with the following description setting forth two embodiments of this invention in the best mode I now know for putting this invention into practice. In these drawings, the same reference numerals indicate like parts throughout the various views.

FIG. 1 is a sectional view taken along the plane 1—1 in FIG. 2, as seen looking downwardly, showing the door-barring lock apparatus in position for barring the door against opening. The margin of the door and the wall of the building, including the door frame or jamb near the doorway and the lock apparatus, are seen in section, with the bar-controlling handle being located on the inside of the building.

Figure 3:
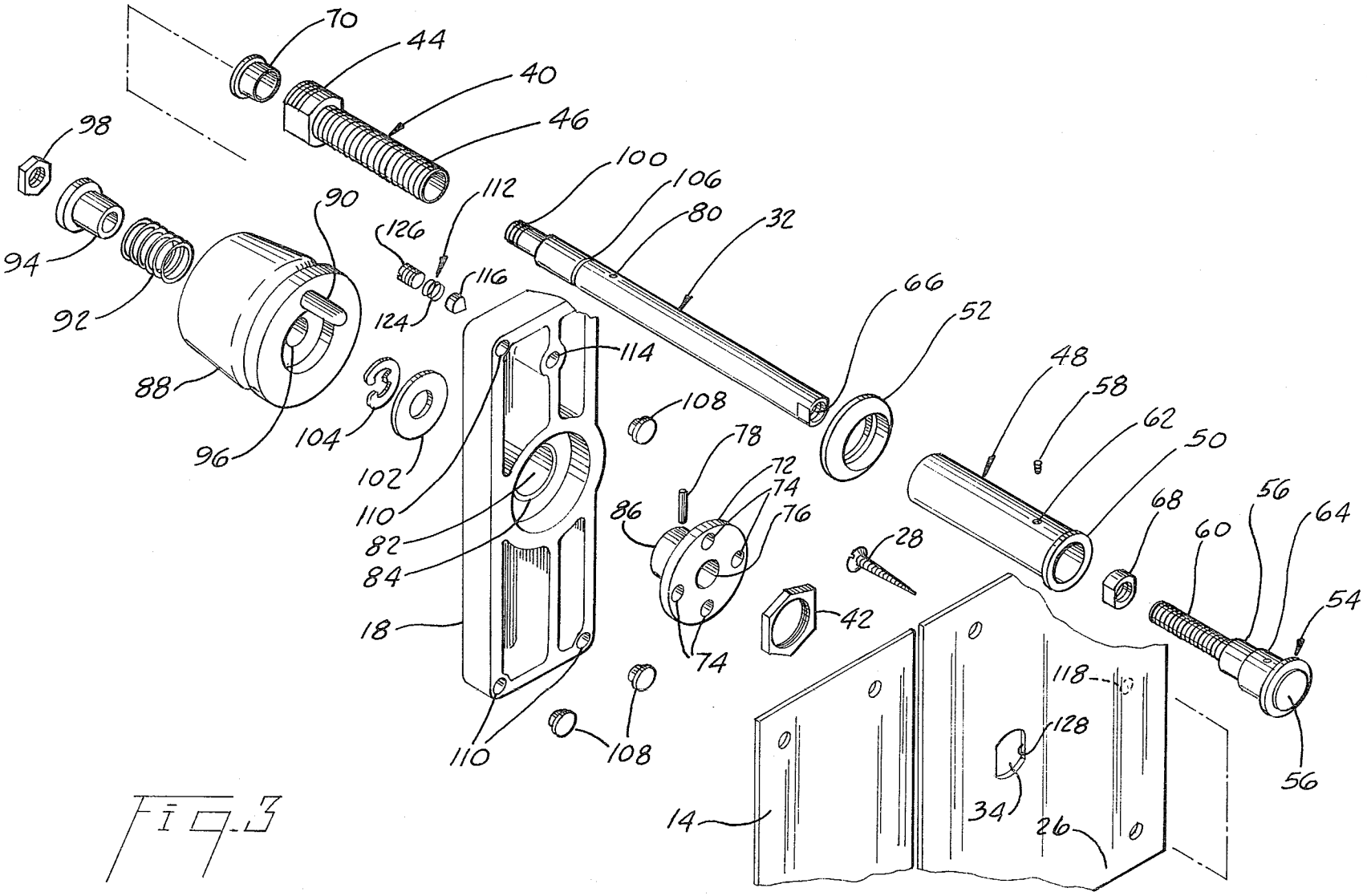
FIG. 3 is an exploded perspective view showing the components of the door-barring lock apparatus of FIGS. 1 and 2.
Figures 4, 4A:
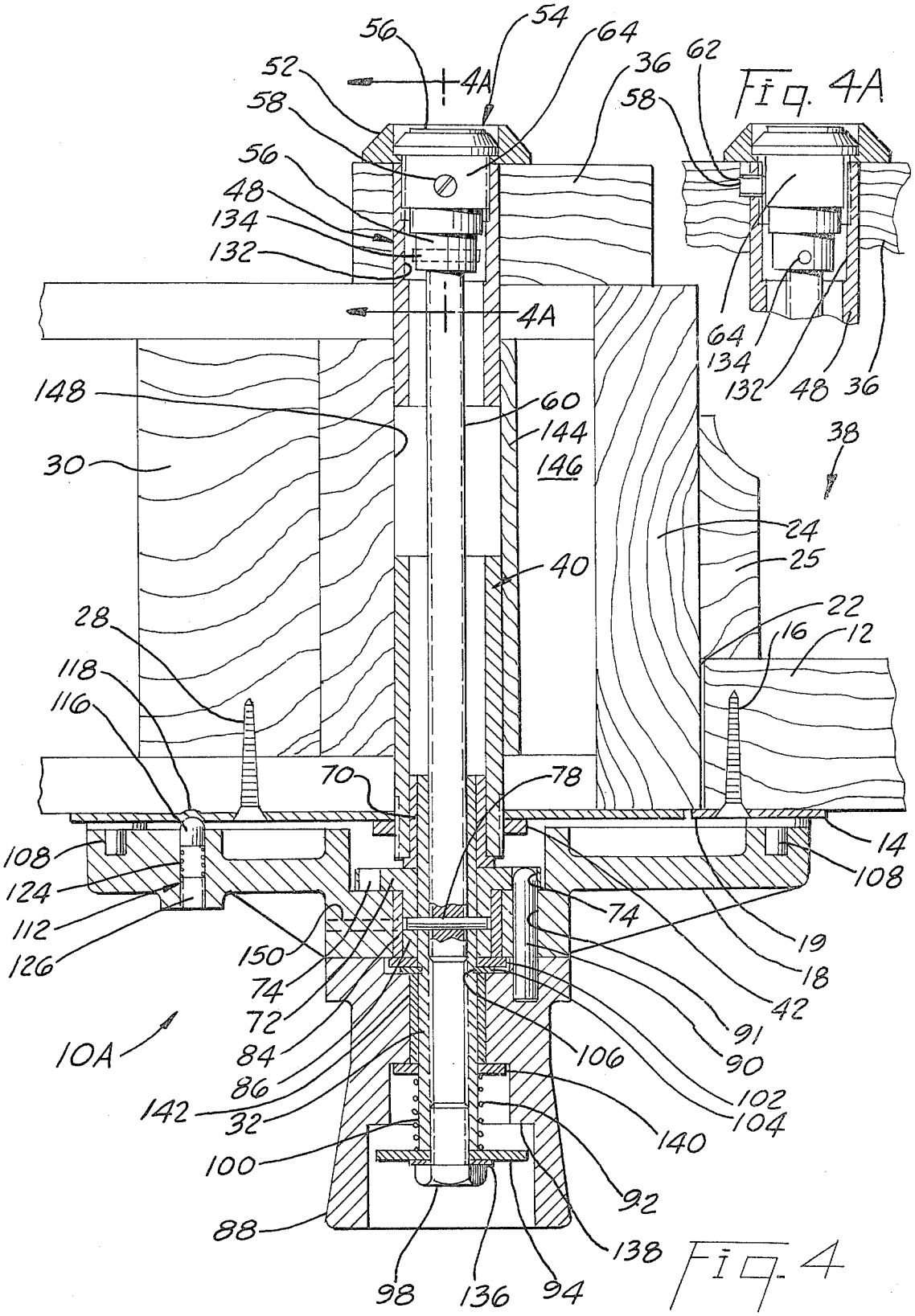
Figure 5:
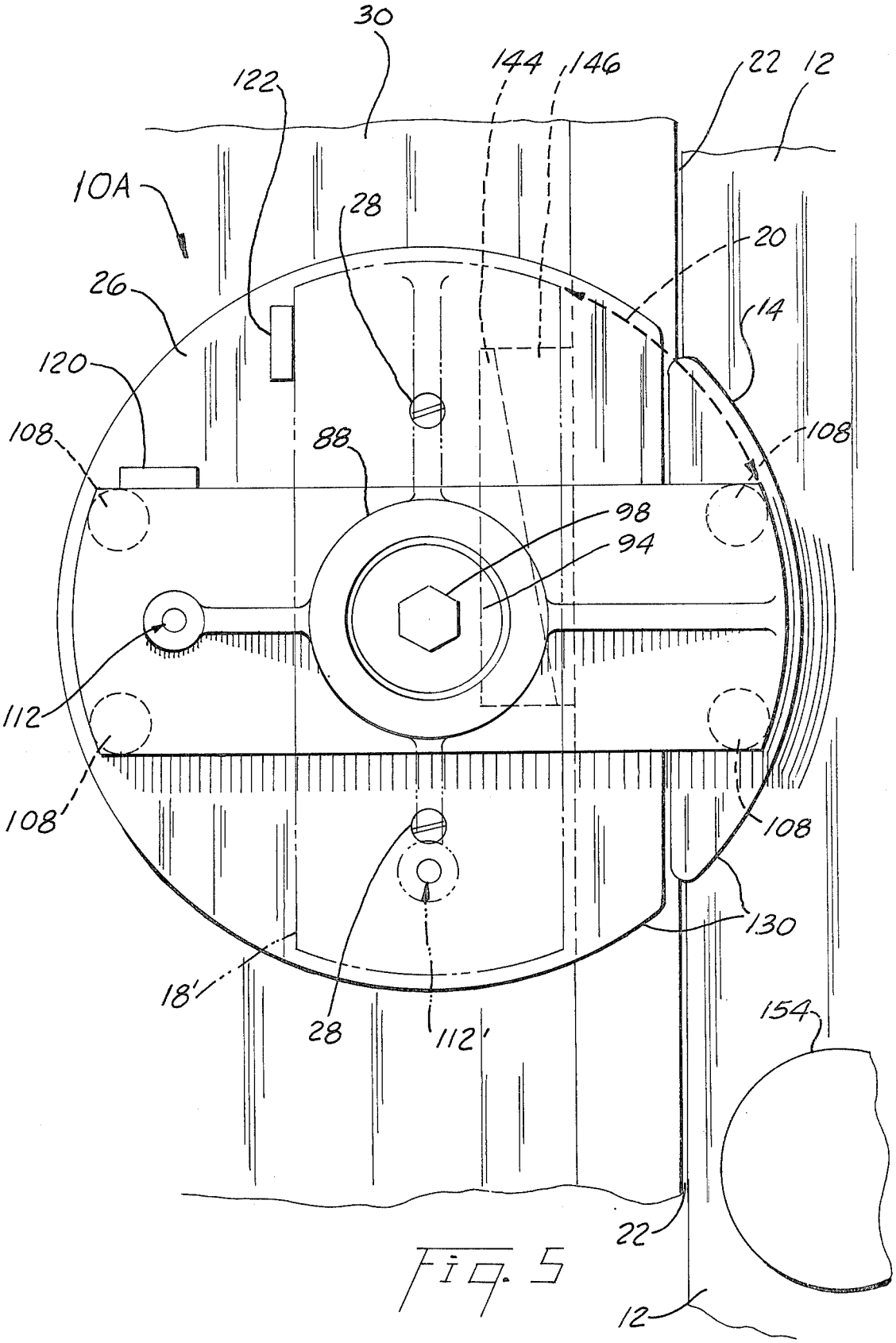

FIG. 4 is a sectional view taken along the plane 4—4 in FIG. 5 illustrating a second embodiment of the invention. FIG. 4 is a view similar to FIG. 1, but FIG. 4 is drawn in a larger size. The embodiment of FIG. 4 provides a different way from FIGS. 1–3 for accommodating for different wall thicknesses.

FIG. 4A is a partial sectional view taken along the plane 4A—4A in FIG. 4 showing the lock assembly anchored against rotation in the building structure.

FIG. 5 is a front view of the door-barring lock apparatus of FIG. 4 as seen looking from inside the building

DETAILED DESCRIPTION OF PREFERRED EMBODIMENTS

Figure 1:
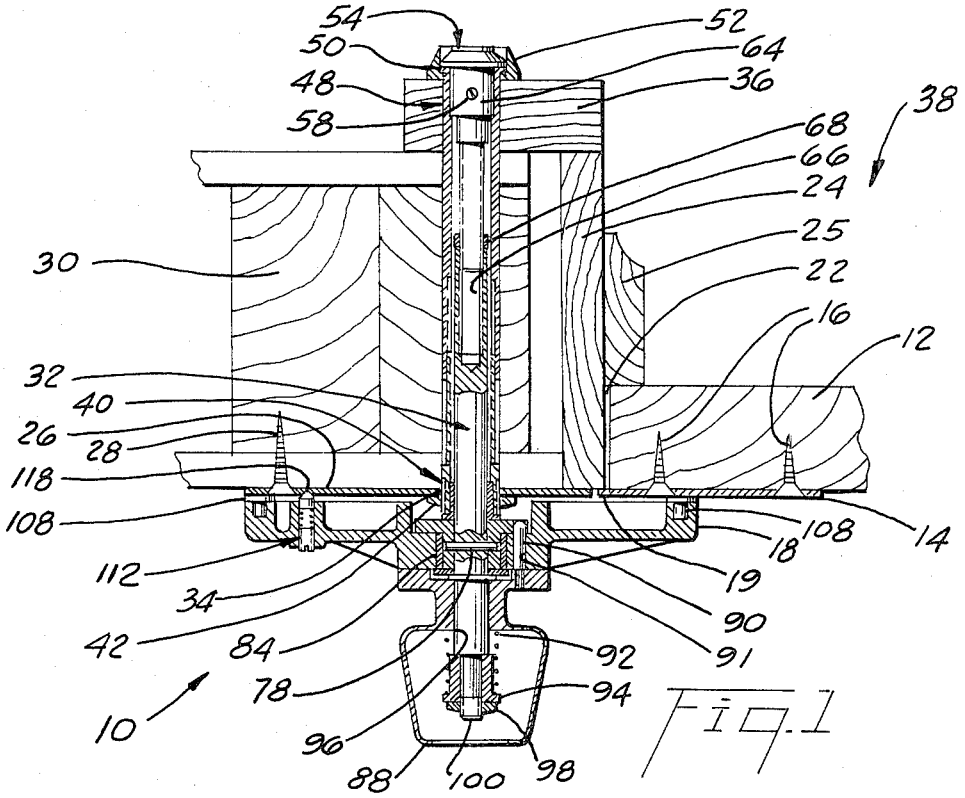
Figure 2:
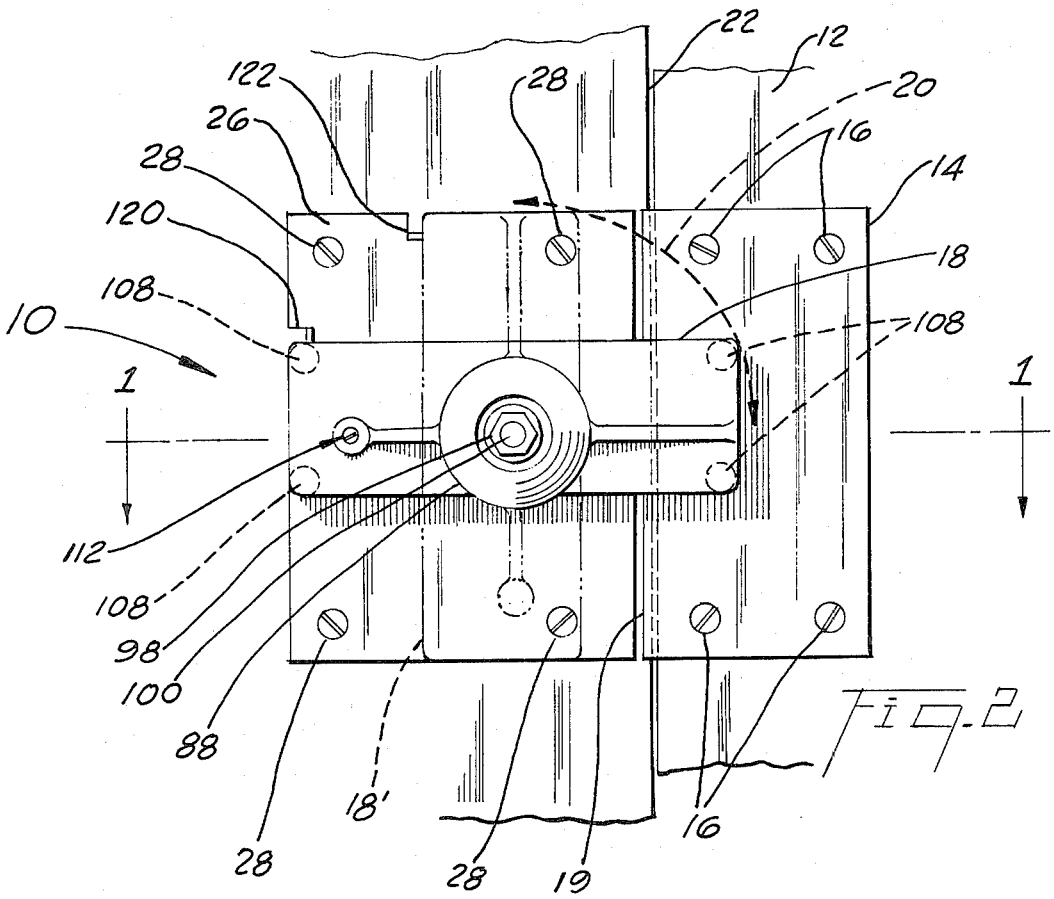
FIG. 2 is a front elevational view, as seen looking toward the lock apparatus from inside the building, the bar member is shown in its tranverse (generally horizontal) position for barring the door. The upright position of the bar member shown in dash-and-dotted outline frees the door for opening inwardly.

Inviting attention to FIGS. 1 and 2, there is shown a door-barring lock apparatus 10 embodying the present invention. The margin portion of the door 12 on the inside of the door in a location opposite to the hinges is covered by an attractive door plate 14 which is suitably secured to the door 12 by attachment means 16, for example, such as screws. This door plate may be rectangular as shown or rounded, or partial-circular in outline. Its purpose is to cover the inside surface of the door in the area which is swept over by the lockable, rotatable bar member 18, including the arc of travel 20 of the end of this bar member 18. It is noted that the edge 19 of this door plate 14 advantageously extends beyond the margin of the door and overlaps the clearance space 22 between the door 12 and the upright frame or jamb 24 of the building structure adjacent to the doorway. Therefore, anyone attempting to tamper with the door bar member 18 by inserting a thin implement through the clearance space 22 from the outside of the building is prevented from access by the overlapping edge 19 of the door plate. The doorstop secured to the jamb 24 is shown at 25.

On the inside wall surface adjacent to the door opening and aligned with the door plate 14, there is a wall plate 26 which is secured to the building structure by suitable fastening means, such as relatively large screws 28. This wall plate 26 may be rectangular in outline or may be rounded. It is my preference that this plate 26 cover the inside wall surface in the entire area where the bar member 18 is located and can be rotated.

The door bar member 18 is rotatably mounted to the wall structure 30 of the building by mounting means including a rotatable rod 32 (See also FIG. 3) extending through the wall structure near the adjacent portion of the doorway as defined by the jamb 24. This rod 32 extends through an opening 34 in the wall plate 26 and through the wall structure 30 and through the trim 36 on the outside of the building by the doorway 38.

The rotatable rod 32 is surrounded by a sleeve 40 (See also FIG. 3) extending through the wall plate opening 34 and secured in position by a fastening ring nut 42. This ring nut 42 engages the enlarged externally threaded end 44 of the sleeve 40, which includes flat surfaces, as shown in FIG. 3, for tightening this sleeve 40 in position according to the thickness of the wall structure 30, as will be explained later. The sleeve 40 has an externally threaded end 46 of reduced diameter which screws into a second sleeve 48 with an external flange 50 seating in an external retainer ring 52 which rests flush against the trim 36. Thus, the sleeves 40 and 48 when screwed together form a continuous sleeve surrounding the rotatable rod 32.

In order to lock and unlock the rotatable rod 32 there is a lock assembly 54 having a rotatable lockable plug 56 attached to a rod-like extension 60. The lock assembly 54 has an external shoulder which neatly fits into a recess in the ring 52 as seen in FIG. 1 and seats against the flange 50 of the sleeve 48. A set screw 58 threaded through a hole 62 in the second sleeve 48 holds anchors the casing 64 of the lock assembly 54 fixed in position relative to this sleeve 48. The rod-like extension 60 of the lock plug 56 is threaded into the bore 66 of the rod 32 and is secured thereto by a lock nut 68.

When the lock 54 is unlocked, the plug 56 can be rotated by the key (not shown) relative to the lock casing 64. Thus, the extension 60 and the rod 32 can be turned by the key when the lock is unlocked. In order to permit the inner end of the rod 32 to turn freely within the sleeve 40, there is a flanged bushing 70 seated in the enlarged inner end 44 of the sleeve 40.

For coupling the bar member 18 to the rod 32, there is a latch collar 72 containing multiple sockets 74, four of such sockets being shown in FIG. 3. This latch collar 72 has a bore 76 fitting snugly onto the rod 32, and the latch collar is rigidly fixed in position on the rod 32 by a pin 78 engaging in a hole 80 in the rod 32.

The bar member 18 has a bore 82 containing a bushing 84 which is rotatably mounted on the cylindrical boss 86 of the latch collar 72.

There is a handle 88 for de-coupling the bar member 18 from the latch collar 72 to enable a person inside the building to turn the bar member 18 into its upright position at 18' (FIG. 2) for unbarring the door. Therefore, the door can be opened from the inside by manipulating the handle 88 regardless of whether the lock assembly 54 is locked. This handle 88 includes a latch pin 90 extending through a passageway 91 (FIG. 1) in the bar member and normally engaging in one of the sockets 74. A compression spring 92 held by a spring holder bushing 94 presses the handle 88 toward the latch collar 72. The bore 96 of the handle 88 is slidably mounted on the rod 32, and a lock nut 98 screwed onto the threaded inner end 100 of the rod 32 fastens the spring-holding bushing 94 fixed in position on the rod 32. A washer 102 held by a C-shaped fastener 104 engaging in a groove 106 in the rod 32 prevents the bar member 18 and its bushing 84 from sliding off from the cylindrical boss 86 of the latch collar 72, while the bar member can freely rotate relative to the latch collar 72 when the latch pin 90 is withdrawn from a socket 74. This washer 102 and fastener 104 thus hold the bar member 18 for preventing the bar member from moving inwardly relative to the rod 32.

The spring 92 normally urges the handle 88 toward the latch collar 72 for engaging the pin 90 in a socket 74. When the user pulls on the handle 88, the handle slides on the rod 32 while compressing the spring 92 for withdrawing the pin 90 from a socket 74, thereby freeing the bar member 18 to be turned by the handle 88 into the transverse door-barring position or into the upright position 18' (FIG. 2) for freeing the door to be opened.

The bar member 18 includes multiple slide pads 108 of slippery plastic mounted in recesses 110 in the face of the bar member 18 facing the plates 14 and 26. Also, there is a spring-biased detent assembly 112 mounted in a hole 114 in the bar member 18. The tip of the detent element 116 engages in a small depression 118 (FIG. 1) in the wall plate 26 when the bar member is turned into its door-barring position. This detent assembly includes a compression spring 124 and a set screw 126 which screws into the threaded hole 114.

There is a second similar depression (not shown) in the wall plate 26 which is engaged by the detent element 116 when the bar member 18 is turned into its upright position 18'. The purpose of this detent assembly 112 and the two depressions 118 in the wall plate 26 is to assure that the bar member 18 remains exactly in its upright unbarred position 18' or exactly in its transverse door-barring position.

In order to limit the rotation movement of the bar member 18 to the desired arc of travel 20, the wall plate 26 includes first and second stops 120 and 122 projecting inwardly from its surface. The first stop 120 is contacted by the bar member 18 when turned into the transverse door-barring position, as shown in FIG. 2. The second stop 122 is contacted by the bar member when turned into its unbarring upright position. These two positions are oriented 90° from each other in this embodiment.

The reason why there are four sockets 74 spaced 90° apart around the axis of the latch collar 72 will now be explained. Assume that a person bars the door by inserting a key into the lock plug 56 and then turns the shaft 32, latch collar 72, together with the bar member 18, for placing the bar member into its transverse position. Then, assume that the door is unbarred from inside of the door by pulling on the handle 88 for disengaging the pin 90 from a socket 74, and by then turning the handle together with the bar member counterclockwise. The result is that the pin 90 now becomes engaged in a socket 74 which is located 90° counterclockwise from the original socket.

Assume that once again a person bars the door by locking it from the outside, and then the door is unbarred by a person again turning the handle 88 counterclockwise. The result is that the pin 90 now becomes engaged in a socket 74 which is located 180° counterclockwise from the original socket. And so forth, each sequence of locking (barring) from outside of the building and unlocking (unbarring) from inside of the building will advance the pin 90 counterclockwise by 90° to the next successive socket 74.

Conversely, each sequence of barring from the inside and then unbarring by using the lock plug 56 and a key on the outside will advance the pin 90 clockwise by 90° to the next successive socket.

In view of the fact that the angular difference between the transverse and upright positions of the bar member is 90°, it will now be understood that four sockets 74, as shown, will allow unlimited repeated sequences of outside/inside locking and unlocking, respectively, and also will allow unlimited repeated sequences of inside/outside locking and unlocking, respectively.

It is to be understood that the lock 54 is of a type in which the plug 56 can be turned in either direction when unlocked by insertion of a key and in which the plug 56 locks at angular increments of 90°, i.e. at four equally spaced angular positions. A suitable commercially available lock 56 is, for example a double-bitted lock Model No. 2625 made by Chicago Lock Co. of Belmont Avenue, Chicago, Ill., which includes the extension 60. Another suitable lock is, for example their seven-pin tumbler Model 4107, which was a tubular-type key.

Although my presently preferred angular difference between upright and transverse positions of the bar member 18 is four equal increments of 90°, it is to be understood that this door-barring lock apparatus can be arranged to employ other multiples of equal angular increments, for example five equal increments of 72° or six equal increments of 60°, in which event there are five or six, respectively, equally spaced sockets 74 in the latch collar 72. The rotation limit stops 120 and 122 (FIG. 2) and the detent depressions 118 (FIGS. 1 and 3) are then appropriately positioned, for 72° or 60° arc of travel, as the case may be. The lock plug 56 is then capable of being turned in either direction and of being locked in various angular positions of equal incremental differences of 72° or 60°, as the case may be. Also, three 120° increments can be used.

During installation of this door-barring lock apparatus 10 the installer determines the wall thickness and appropriately adjusts the effective length of the rod 32 by screwing it onto the rod-like extension 60 and then tightening the lock nut 68. The outer sleeve 48 is screwed onto the inner sleeve 40 to provide appropriate length for the flange 50 to pull the ring 52 snug against the trim 36. There is at least one flat 128 (FIG. 3) in the opening 34 in the wall plate 26 which engages a corresponding flat on the enlarged end 44 of the sleeve 40 for holding this sleeve against turning relative to the other sleeve 48, while the fastening ring nut 42 is being tightened against the wall plate for anchoring the sleeves 40 and 48 firmly in position in the wall structure 30.

Inviting attention to FIGS. 4, 4A and 5, this second embodiment of the door-barring lock apparatus is generally indicated at 10A and has numerous features similar to those of the apparatus 10 of FIGS. 1-3. For convenience of explanation, only the differences will now be described.

The door and wall plates 14 and 26 together have an overall circular configuration 130 giving a pleasing bulls-eye motif to the apparatus, as seen in FIG. 5, from inside the building. The ends of the bar member 18 are rounded to be concentric with this circular configuration 130, and its arc of travel 20 is concentric therewith.

The outer or second sleeve 48 is internally threaded at its outer end at 132 to receive the externally threaded casing 64 of the lock 54 which is secured in place by a set screw 58 threaded into the opening 62 in the sleeve 48. This set screw 58 is intentionally allowed to protrude beyond the sleeve 48, as shown in FIG. 4A, for anchoring the sleeve 48 in the wall structure or trim to prevent turning of this sleeve. It is noted that the fastening ring 52 includes a recess with an internal shoulder, and the lock casing 64 includes an external shoulder which seats directly down into the ring 52 against the internal shoulder of this ring.

The rod-like element 60 is fastened to the lock plug 56 by a pin 134 and is relatively long.

The first or inner sleeve 40 includes a bushing 70 as shown in FIGS. 1 and 3, but the inner end of this sleeve 40 is not enlarged. The fastening nut 42 screws onto the exterior threading at the inner end of this inner sleeve 40.

Instead of the rod 32 (FIGS. 1 and 3), the rod-like element 60 of the lock plug 56 is attached to a tubular member 32 which is internally threaded along its whole length and effectively lengthens this rod element 60. This tubular rod extender 32 is used to accommodate different wall thicknesses as will be explained later. The inner end 100 of the tubular rod extender 32 receives a machine screw 98 which, together with a lock washer 136, serve the same function as the lock nut 98 (FIGS. 1 and 3), namely, to hold an element 94 which in turn holds the compression spring 92. The spring-holding element 94 in this embodiment is a washer which also acts as a limit stop for the handle 88. When the handle 88 is pulled inwardly for de-coupling its pin 90 from one of the sockets 74 in the latch collar 72, an internal shoulder 138 in the handle 88 contacts the limit stop washer 94. There is a washer 140 seated in the handle 88 for receiving the thrust of the spring 92 for preventing galling of the softer handle 88 by the harder spring 92. As will be understood, the handle 88 may be made of softer material than the spring 92, for example of brass, aluminum or plastic. There is a bushing or sleeve 142 within the handle 88 slidably fitting around the rod extender element 32. The C-shaped fastener 104 for holding the washer 102 engages in a groove 106 in the rod extender element 32.

During installation, the installer may insert a pair of wood wedges 144, 146 between the door frame 24 (jamb) and the wall studs of the wall structure 30 for assuring that the hole 148 to be drilled through the wall structure for receiving the door-barring lock apparatus 10A will run true, i.e. will not deflect toward the door frame 24. The appropriate length of the rod 60 is determined in accordance with the wall thickness. If this rod 60 is too long, it may be cut off, but usually it will not be too long, because the tubular rod extender 32 accommodates a substantial range of adjustments for various wall thicknesses.

The apparatus 10A is assembled, except that the pin 78 is not yet installed. The nut 42 is screwed into a position for locating the bushing 70 so that the slide pads 108 are spaced away from the wall plate by the thickness of a sheet of newspaper. There is a drill guide hole 150 provided in the bar member 18. Using a drill guided by the guide hole 150, a hole is then drilled through the bushing 84 through the cylindrical portion 86 of the latch collar 72, through the tubular rod extender element 32 and through the rod 60, so that a tight-fitting pin 78 can be inserted for permanently securing the tubular rod extender 32 to the rod 60 in its appropriate adjusted position on the rod and for securing the latch collar 72 permenently fixed in position on the assembled rod 32–60. The last assembly step is tightening the spring holder element 98 against the lock washer 136.

During assembly, the nut 42 is turned slightly to provide slight clearance between the bushing 70 and the latch collar 72 when the slide pads 108 of the bar member 80 are in contact with the wall plate 26 for achieving free rotation of the bar member 18.

It is to be understood that the door 12 in each embodiment includes a hand hold or handle on the inside for enabling the door to be swung inwardly. There is also such a hand hold or handle on the outside for pulling the door closed. Such a handle 154 is shown on the inside of the door in FIG. 5.

The lock plug 56 is unlocked from its casing as soon as the proper key is fully inserted into the plug 56 in a keyhole (not shown). Thus, the lock 54 itself is said to be "unlocked" by full insertion of the proper key. Thereafter, the rod 60–32 can be turned by turning the plug 56 by use of the key as a handle.

While the novel features of the invention have been illustrated and described in connection with specific embodiments of the invention, it is believed that these embodiments will enable others skilled in the art to apply the principles of the invention in forms departing from the exemplary embodiments herein, and such departures are contemplated by the following claims.

I claim:

1. Door-barring lock apparatus for holding an inwardly-swinging hinged door in its closed position in the doorway in the wall structure of a building or for releasing the door to be opened inwardly comprising:

an elongated rotatable rod extending through the wall structure of the building near the doorway on the opposite side of the doorway from the location of the hinges for the door, said rod extending through the wall structure from the inside to the outside of the building, anchor means secured to the wall structure for preventing rotation, said rod normally being rotatable about its own axis relative to said anchor means, a lock available from the outside of the building near said doorway, said lock having a rotatable portion coupled to said rod, said lock having a stationary portion anchored in position by said anchor means, said lock having a locked condition and an unlocked condition, said lock in its locked condition preventing said rod from rotating relative to said anchor means, said lock in its unlocked condition permitting said rod to be rotated, a door bar member movably mounted near the inside surface of the wall structure and being movable between extended and retracted positions, said bar member when in its extended position engaging the inside surface of the door on the opposite side from the hinges for barring the door against opening inwardly, said bar member in its retracted position being located away from the door for unbarring the door and for allowing the door to be opened inwardly, coupling means normally coupling said bar member to the inner end of said rotatable rod for enabling the door to be barred or unbarred from the outside by unlocking said lock and then turning the rod, and a handle near said bar member associated with said coupling means for decoupling said bar member from said rod for permitting said bar member to be moved between its extended and retracted positions by a person inside of the building regardless of the fact that said lock is in its locked condition, for enabling the door to be barred or unbarred from the inside of the building by manipulation of said handle.

2. Door-barring lock apparatus, as claimed in claim 1, in which:

said coupling means includes means for positively defining a plurality of angular positions of said bar member relative to said rod, said angular positions being spaced apart by equal angular increments, and said coupling means being capable of coupling said bar member to said rod in each of said angular positions.

3. Door-barring lock apparatus, as claimed in claim 1, in which:

said coupling means includes a member secured to said rod defining a plurality of sockets therein spaced about the axis of said rod, said bar member has an associated element engageable with any one of said sockets for positively defining a plurality of angular positions of said bar member relative to said rod, and said sockets are spaced apart by equal angular increments around the axis of said rod.

4. Door-barring lock apparatus, as claimed in claim 3, in which:

said handle is secured to said element, said element is slidable relative to said bar member in a direction parallel with the axis of said rod for engaging the element with a socket and for disengaging the element from a socket, said element is associated with said bar member for preventing said element and bar member from changing their angular positions with respect to each other, and spring means are provided for normally urging said element toward engagement with one of the sockets defined by said member.

5. Door-barring lock apparatus, as claimed in claim 4, in which:

said handle is mounted on said rod, said handle is slidable axially relative to said rod and is rotatable about said rod, said spring means also being mounted on said rod, and holding means are provided for holding one end of said spring means in predetermined axial position relative to said rod with the other end of said spring means urging said handle toward said socket-defining member.

6. Door-barring lock apparatus, as claimed in claim 4, in which:

said element is a pin, said bar member has a passageway therethrough offset from the axis of said rod and aligned with said pin, said pin extends through said passageway and is slidable axially in said passageway, and stop means for permitting said handle to be moved in an axial direction sufficiently far to disengage said pin from the socket-defining member while retaining the pin in said passageway for enabling the bar member to be rotated by the handle after said pin has been disengaged from the socket-defining member.

7. Door-barring lock apparatus, as claimed in claim 5, in which:

said element is a pin secured to the handle in a position offset from the axis of said rod, said pin extends axially parallel with the axis of said rod, said bar member has a passageway therethrough offset from the axis of said rod and aligned with said pin, said pin extends through said passageway and is slidable axially in said passageway, and stop means for permitting said handle to be moved in an axial direction sufficiently far to disengage said pin from the socket-defining member while retaining the pin in said passageway for enabling the bar member to be rotated by the handle after said pin has been disengaged from the socket-defining member.

8. Door-barring lock apparatus, as claimed in claim 2, 3, 4, 5 or 6, in which:

said plurality of angular positions are in the range from 3 to 6, inclusive, and said equal angular increments are increments of 120°, 90°, 72° or 60°, respectively.

9. Door-barring lock apparatus, as claimed in claim 8, in which:

a wall plate is mounted on the wall, said wall plate has an opening therein, said rod extends through said opening, and said wall plate has stop means for limiting the arc of travel of said bar member to the respective angular increment.

10. Door-barring lock apparatus, as claimed in claim 9, in which:

a door plate is mounted on the inside of the door in a position for being contacted by said bar member in its extended position.

11. Door-barring lock apparatus, as claimed in claim 10, in which:

the wall plate plus the door plate as seen from inside the building when the door is closed define a circular peripheral configuration with the rod, the handle and the respective ends of the bar member being concentric with said peripheral configuration.

12. Door-barring lock apparatus for holding an inwardly-swinging hinged door in its closed position in the doorway in the wall structure of a building or for releasing the door to be opened comprising:

an elongated rotatable rod extending through the wall structure of the building near the doorway on the opposite side of the doorway from the location of the hinges for the door, said rod extending through the wall from the inside to the outside of the building, anchor means secured to the wall structure, said rod being rotatable about its own axis relative to said anchor means, a lock operatively associated with said anchors means and being available from the outside of the building near said doorway said lock being connected to said rod, said lock having a locked condition and an unlocked condition, said lock in its locked condition connecting said rotatable rod to said anchor means for preventing said rod from rotating relative to said anchor means, said lock in its unlocked condition permitting said rod to be rotated, a door bar member mounted near the inside surface of said wall structure and being rotatable about the axis of said rod into transverse and upright positions, said bar member when in its transverse position engaging the inside of the door on the opposite side from the hinges for barring the door against opening inwardly, said bar member in its upright position being located away from the door for unbarring the door for allowing the door to be opened, a first position-defining member secured to said rod in fixed angular position relative to said rod, said bar member having a second position-defining member associated therewith in fixed angular position relative to said bar member, one of said position-defining members having a plurality of elements at least three in number spaced about the axis of said rod by equal angular increments, each of said angular increments being equal to the angular difference between the transverse and upright positions of said bar member, said first and second position-defining members being mechanically engageable in coupled relationship in a plurality of relative angular positions as defined by said plurality of elements for enabling said bar member to be coupled to said rod with said rod at a plurality of angular positions at least three in number relative to said bar member, and a handle inside the building associated with one of said position-defining members for de-coupling said bar member from said rod for permitting said bar member to be turned between its transverse and upright positions by a person inside of the building regardless of the fact that said lock is in its locked condition, for enabling the door to be barred or unbarred from the inside of the building by manipulation of said handle independently of whether the lock is in its locked or unlocked condition, said first and second position-defining members thereby advantageously enabling said door-barring lock apparatus to be operated in any repititive barring/unbarring sequence from inside or outside of the building in any order.

13. Door-barring lock apparatus, as claimed in claim 12, in which:

spring means are provided for normally urging said first and second position-defining members toward each other into their coupled relationship, and manipulation of said handle overcomes the spring action for enabling decoupling of the bar member from the rod.

14. Door-barring lock apparatus, as claimed in claim 12, in which:

said first position-defining member contains said plurality of elements.

15. Door-barring lock apparatus, as claimed in claim 12, 13, or 14 in which:

said plurality of elements in one of said position-defining members are a plurality of sockets, and the other position-defining member is an element engageable with said sockets.

16. Door-barring lock apparatus for barring an inwardly-swinging hinged door in its closed position in the doorway in the wall structure of a building for unbarring the door to be opened inwardly comprising:

an elongated rotatable rod extending through the wall structure of the building near the doorway on the opposite side of the doorway from the location of the hinges for the door, said rod having an inner end and an outer end relative to the inside and the outside of the building, said rod being mounted for rotating about its own axis within said wall structure, a lock available from the outside of the building near said doorway coupled to said outside end of said rod, anchor means fixed against rotation relative to the wall structure, said lock being operatively associated with said anchor means and having a locked condition and an unlocked condition, said lock in its locked condition preventing said rod from rotating relative to said anchor means, said lock in its unlocked condition permitting said rod to be rotated, a door bar member movably mounted near the interior surface of said wall structure and having a first position in which said door bar extends laterally from said wall structure into a barring position relative to the door and a second position in which said door bar is removed from such door-barring position, said bar member when in its first position engaging the inside surface of the door on the opposite side from the hinges for barring the door against opening inwardly, said bar member in its second position being located away from the door for unbarring the door for allowing the door to be opened inwardly, said bar member being operated by the inner end of said rod for enabling the door to be barred or unbarred from the outside by locking or unlocking said lock and then turning the rod, and a handle associated with said bar member for permitting said bar member to be moved between its first and second positions by a person inside of the building regardless of the fact that said lock is in its locked condition, for enabling the door to be barred or unbarred from the inside of the building by manipulation of said handle.

* * * * *